United States Patent [19]

Braun

[11] Patent Number: 4,733,502

[45] Date of Patent: Mar. 29, 1988

[54] METHOD FOR GRINDING AND POLISHING LENSES ON SAME MACHINE

[75] Inventor: Gary A. Braun, Geneva, N.Y.

[73] Assignee: Ferro Corporation, Cleveland, Ohio

[21] Appl. No.: 903,493

[22] Filed: Sep. 4, 1986

[51] Int. Cl.[4] ..... B24B 1/00; B24D 11/00

[52] U.S. Cl. ..... 51/284 R; 51/DIG. 34; 51/406; 51/407

[58] Field of Search ..... 51/DIG. 34, 284 R, 209 D, 51/209 L, 318, 401, 406, 407, 326, 328, 327, 165.72, 4, 3, 5 R, 124 L

[56] References Cited

U.S. PATENT DOCUMENTS

| | | | |
|---|---|---|---|
| 2,554,070 | 5/1951 | Stead | 51/284 |
| 3,128,580 | 4/1964 | Davis | 51/DIG. 34 |
| 3,290,828 | 12/1966 | Bonin | 51/284 |
| 4,288,233 | 9/1981 | Wiand | 51/295 |
| 4,576,612 | 3/1986 | Shukla et al. | 51/295 |

*Primary Examiner*—Frederick R. Schmidt
*Assistant Examiner*—Blynn Shideler
*Attorney, Agent, or Firm*—Shlesinger, Fitzsimmons & Shlesinger

[57] ABSTRACT

The method of both the surface grinding, or fining, and the polishing of a lens are accomplished on the same surfacing machine spindle, precisely reproducing the curvature and alignment from fining to polishing, thereby resulting in improved surface quality and optical properties. The fine grinding and polishing are accomplished using plain water by sequentially securing to and releasing from the lap, via a high shear-low peel strength adhesive, (a) a fixed abrasive fining pad, and then (b) a polishing pad consisting of a water soluble matrix containing the polishing particles.

10 Claims, 4 Drawing Figures

METHOD FOR GRINDING AND POLISHING LENSES ON SAME MACHINE

BACKGROUND OF THE INVENTION

This invention relates to the grinding and polishing of optical lenses, and the like, and more particularly to an improved method and apparatus for performing the grinding and polishing operations on the same machine spindle, and with the same lapping head.

The overall operation for producing a glass or plastic lens surface of optical quality has generally comprised the following sequence of three steps, each of which are normally performed on different machines:

(1) The first step is rough curve generation using a tool having a preformed, curved surface which is plated or impregnated with diamond, tungsten carbide, or other super hard particles of the desired grit size. This tool is used to generate a lens blank to form thereon the desired radius or radii of curvature, relying upon the principles of geometry and mechanical relationships between the tool and the lens blank.

During this operation a coolant swarf is normally utilized to prevent heat build-up which would cause the lens blank to fracture or warp, and which also allows the feed rate to be maximized. The resultant lens blank surface usually is of the approximate curvature required, but it is neither precise enough nor smooth enough to polish to the desired, final state.

(2) The second step is the surface grinding operation, sometimes also called the fining or smoothing operation. This intermediate step causes the surface geometry of the blank to be corrected to the exact requirement, and produces a surface texture that is smoothed sufficiently to enable the lens blank thereafter to be polished from a generally milky, non-transparent to a transparent state. Typically the preformed tool or lap that is used in this operation is made of a rigid material such as cast iron or aluminum, and has machined or otherwise formed thereon the precise, desired curve, so that when the lens blank and lap are engaged, and one is oscillated, rotated, vibrated or otherwise moved relative to the other, the lap will produce on the lens blank the desired surface geometry.

Normally to assist in the removal of the desired quantity of glass or plastic from the blank in this operation, an abrasive slurry stream is continuously played onto the lap-lens blank interface, and the abrasive slurry is thereafter recaptured and recirculated. When the surface grinding action has taken place for a time sufficient to remove all generator marks, and to true the surface geometry of the blank, the lens blank and the lap are removed from the surface grinding machine and rinsed thoroughly to completely remove all abrasive particles. This is necessary to prevent contamination of the slurry used during the polishing operation which follows and thus avoids any undesirable scratches or other surface defects which might occur if any of the grinding slurry were to remain.

(3) The final polishing step transforms the non-transparent lens surface to its transparent state, while maintaining the exact surface geometry that will produce the desired optical properties. Typically the same lap or tool which was used for the surface grinding operation is again utilized, but this time in a polishing machine and with a polishing pad adhered to its surface. This may cause a slight or minimal change in the radius of curvature of the lap surface, but it also permits a polishing slurry to be directed onto the lens blank-lap interface. In order to achieve a high quality, fully polished lens surface, it is necessary that the polishing lap surface exactly match the ground lens surface which is presented to it at the start of a polishing operation, or alternatively, that the polishing lap surface be very slightly off curve to a calculated degree so that the lens will polish from the "edge in", or from the "center out", depending upon the conditions desired.

Referring to the above-noted surface grinding step (2) it is possible to use a grinding lap, the operating surface of which is bare—i.e. has no separate grinding pad attached thereto. When this type of tool is utilized, the polishing pad that is used in the subsequent step is normally kept to a minimum thickness, thereby to minimize any curve mis-match that might otherwise result as between the ground surface on the lens and the curved surface presented by the polishing pad. Nevertheless, even when utmost care is taken, when this technique is employed the lap inevitably will drift off-curve after many uses, since the abrasive action during the surface grinding step will wear the lap surface unevenly.

It has been known that this problem can be avoided by attaching to the lap surface a surface grinding pad which will absorb the uneven wear, and which can be removed and replaced after a certain number of cycles, thereby preventing any wear of the lap surface itself. Assuming that the same lap is thereafter employed for polishing, a a polishing pad can then be attached over the surface grinding pad, and after being once used may be removed and discarded. Such a polishing pad, of course, is again kept to a minimum thickness in order to avoid any curve mis-match.

Still another form of grinding utilizes surface grinding pads which are used only once, after which they are removed and discarded. In such cases the polishing pad is then applied to the surface of the bare lap after the surface grinding pad has been removed. With this procedure the polishing pad should be equal to the thickness of the grinding pad, or perhaps be of a slightly different thickness to a calculated degree, or a problem of curve mis-match will result.

From the above, it will be noted that the problem of curve mis-match from grinding to polishing must be avoided if a high quality polished lens surface of good optical properties is to be achieved. To avoid such mismatch, it is necessary to control the curvature of the working surface of the lap, both at the grinding and polishing operations, thus requiring the careful control of the curvature of the bare lap and/or the thickness of the grinding and/or polishing pad, depending on the technique used.

Still another source of curve mis-match, which appears to be overlooked in current practices, is the possibility of accidentally reversing the lap, such as for example, when reinserting it into a machine for use in a polishing operation, rotating it 180° from the position it assumed in the machine during the surface grinding operation. This problem can be obviated by marking each lap and lens blank, during the surfacing operation, so that during the subsequent polishing operation the lap and the lens blank can be loaded in the same mechanical relationship that existed during the grinding operation.

A significant source of potential curve mis-match resides in the very fact that one machine spindle is used for grinding, and a different machine spindle is used for polishing, notwithstanding the fact that the same lap may be employed for both steps. For example, in the usual optical shops, it is common for a lens to be ground in any one of a number of different grinding machines, after which it is transferred to any one of a number of different polishing machines, so that there is virtually no uniformity in the sequence of operations, at least with respect to the machines spindle that are employed. Thus, the grinding machine employed could be rotating, oscillating or vibrating about a different center or off-set, or at a different speed, or in a different direction. Moreover, it could have a different alignment to its toric axes or it could have a different degree of "break-up" motion, than the subsequently used polishing machine spindle.

One solution the the last-mentioned problem would be to employ the same machine for both the surface grinding and the polishing operations, as suggested for example by U.S. Pat. No. 2,554,070. However, that particular solution requires using a single grinding and polishing slurry for both the final grinding and polishing operation, and proved to be extremely unsatisfactory. Moreover, the same machine, or machine spindle, cannot be used with separate grinding and polishing slurries because the recirculation of the surface grinding slurry would cause contamination of the subsequently employed polishing slurry, which of course contains particles of substantially finer grit sizes than the surface grinding slurry. This could cause undesirable scratches to be formed on the lenses during the polishing operation. Of course, if it was not necessary to use a grinding slurry during the surface grinding operation,theoretically there would be no abrasive carried over from the grinding operation to contaminate the polishing operation. Likewise, if a polishing slurry was not necessary for the polishing operation, the slurries could be eliminated altogether.

Heretofore efforts have been made to manufacture so-called "fixed abrasive" pads for use in connection with the surface grinding or fining of a lens blank, as well as in the polishing thereof. By way of example, U.S. Pat. No. 4,255,164 discloses a surface grinding or fining pad in which abrasive particles are embedded in a matrix which, during the grinding operation, gradually erodes or breaks down under the effects of load and surface friction, thereby gradually releasing abrasive granules, which in the presence of water, form at the interface an abrasive slurry sufficient to effect the desired grinding of the lens surface. This obviates the need for employing the usual abrasive slurry, and permits one to use a plain water slurry, or the like. The obvious disadvantage of this pad is that it is designed purposely to release the abrasive particles during the grinding operation, and therefore will result in undesirable cross contamination if any such fining particles appear in the slurry used during a subsequent polishing operation. Surface grinding and polishing therefore must still be performed on separate machines when finishing pads of this type are employed.

Efforts also have been made to produce polishing pads, which obviate or minimize the need for using a polishing compound in the coolant or slurry during a polishing operation. (See for example U.S. Pat. No. 3,713,796.) The disadvantage of most such pads, however, is that they generally do not polish satisfactorily, and often exhibit unsatisfactory rates of removal in connection with the polishing of glass lenses. Moreover, since they heretofore have been used in combination with fining pads of the type which release fining particles during the fining or surface grinding operation, they have not obviated the problem of cross contamination as described above.

It is an object of this invention, therefore, to provide a novel method which will eliminate cross contamination problems heretofore encountered during lens grinding and polishing, thereby to pemit the use of the same machine spindle for both the grinding and the polishing of a lens blank. To this end it is an object of this invention also to provide a novel method in which a plain water slurry, rather than an abrasive slurry and a polishing slurry, is used during each of the grinding and polishing operations, respectively.

Another object of this invention is to provide an improved method of preparing optical lenses which involves using on the lap of the same machine spindle, first a removable lens grinding or fining pad to which abrasive particles are fixed so as to remain attached to the pad during a grinding operation, and thereafter a removable polishing pad to which abrasive polishing particles are secured in a water soluble matrix.

A further object of this invention is to provide an improved method of the type described which utilizes fining and polishing pads, which require only the use of a plain water slurry during grinding and polishing operations, rather than an abrasive slurry.

Still a further object of this invention is to provide a novel method of the type described which utilizes removable fining and polishing pads, each of which is adapted releasably to be attached to the same lap, and to be used in the same machine for both grinding and polishing operations, respectively.

It is also an object of this invention to provide improved apparatus for performing both the fining and polishing operations on a lens blank on the same machine spindle.

Other objects of the invention will be apparent hereinafter from the specification from the recital of the appended claims, particularly when read in conjunction with the accompanying drawing.

SUMMARY OF THE INVENTION

The lap of a conventional surfacing machine first has its curved operating surface covered by a removable fining pad in which the abrasive fining particles are permanently, or nearly permanently, fixed so that their protruding cutting or grinding edges project uniformly equal distances above the matrix in which the particles are fixed, so that they lie in the desired curvilinear surface that is to be ground on a lens blank. The pad is secured to the lap by a special high shear, low peel strength adhesive which permits the pad repeatedly to be applied to and removed from the lap without any consequent damage to the pad. During the fining operation an abrasive-free liquid is applied to the lens-lap interface and after use is discarded to waste, or filtered and recirculated.

After fining, the fining pad is easily removed from the lap and is replaced by a polishing pad of the type having polishing particles embedded in a water soluble matrix, and having on its rear surface a high shear, low peel strength adhesive of the type used on the fining pad. During the polishing operation a simple water slurry (i.e., an abrasive-free slurry) is supplied to the lens-lap interface and discharged to waste during use or recirculated. For both operations the same surfacing machine and lap are employed.

THE DRAWING

DETAILED DESCRIPTION OF THE PREFERRED EMBODIMENTS

In the preferred embodiment of this invention, the fine grinding and polishing of a lens blank are successive operations which are performed on the same surfacing machine and associated lap. For example, in FIG. 1 the numeral 10 denotes generally a lens forming tool or lap which is designed removably to be secured in a conventional surfacing machine, such as for example the type known as a Coburn 505 or 506. Lap 10 has a curved, generally convexedly shaped upper surface 11, and a shank 12 on its lower end for use in mounting the lap on known manner in the associated machine spindle.

Figure 3:
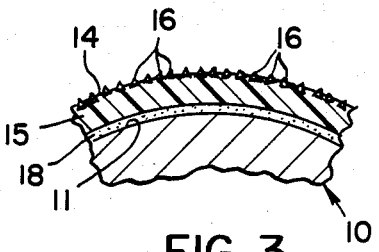
FIG. 3 is an enlarged, fragmentary sectional view taken along the line 3—3 in FIG. 2 looking in the direction of the arrows.
Figure 2:
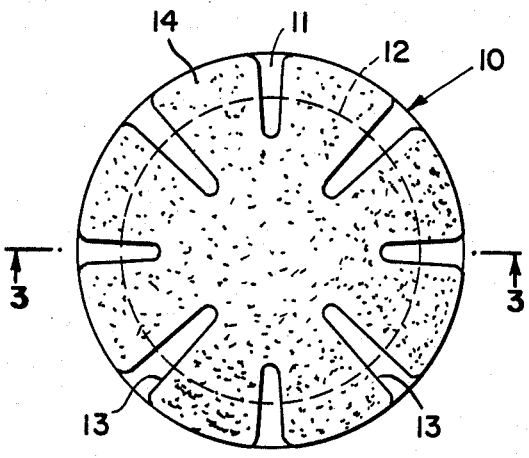
FIG. 2 is a plan view of the fining pad and lap shown in FIG. 1.

Releasably secured to the upper surface of lap 10 is an abrasive fining pad 14 of the fixed abrasive particle variety. Pad 14, which is provided with the usual radial slots 13, comprises a flexible substrate 15 to which are fixed large quantities of abrasive fining particles 16, which merely for purposes of illustration have been shown in FIG. 3 to be generally triangular in cross section. These particles may comprise small diamond or other super hard particles, which are affixed to substrate 15 so that their outer, lens blank-engaging and grinding edges project generally uniform distances from the substrate. More precisely, the pad 14 is designed so that, when in use its particles 16 will project a uniform distance from the surface of the associated lap, thereby assuring that their lens blank engaging edges will lie in a plane precisely comparable to the surface that is to be ground on a lens blank.

As used herein, a fining pad of the fixed abrasive particle variety (i.e., pad 14) refers to a pad of the type which does not release fining particles during the surface grinding or fining of a lens surface. Such pads are constructed so that the fining particles (e.g. particles 16 in FIG. 3) are substantially permanently bonded or secured to the substrate (15 in FIG. 3) by a non-water soluble matrix, so that none of the particles, or substantially none of them is released from the substrate during a fining operation. By way of example, pads of the type disclosed in U.S. Pat. Nos. 4,256,467 or 4,288,233 could be employed provided that the lens blank-engaging and grinding edges of their respective fining particles project, as noted in the preceding paragraph, a uniform distance from the lap surface 11.

Secured to the underside of substrate 15, and releasably engaged with the curved, upper surface 11 of lap 10 is a layer 18 of a special high shear, low peel strength adhesive, which preferably is the type disclosed in copending U.S. patent application Ser. No. 843,469 which was filed Mar. 24, 1986, and which is assigned to the same assignee as this application. Pad 14 is thus releasably secured on lap 10 for engagement by the surface of a lens blank 20 which is to be surface ground.

Blank 20 is mounted on the surfacing machine in the usual manner by a lens block or lens mount 21, which is movable in a conventional manner relative to the pad 14 for the purpose of finish grinding on the blank the desired concave surface. During this grinding operation a water stream, which does not contain abrasive particles, is directed by a tube 22, or the like, onto the interface between the pad 14 and the blank 20. Grinding continues in this manner until the surface of blank 20 has been satisfactorily ground or fined by the pad 14. During this operation the water stream can be discharged to a waste line, or if desired, may be recirculated provided it is first filtered to remove any abrasive particles 16 which might have been dislodged from pad 14 during the fining operation, thus preventing any cross contamination which would result if fining particles were to be present during the subsequent polishing operation.

Figure 4:
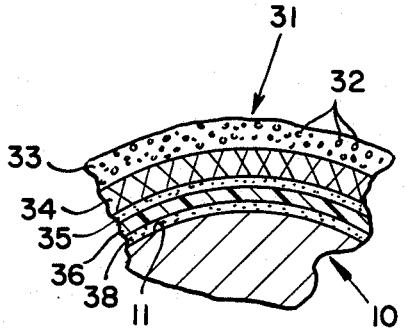
FIG. 4 is an enlarged fragmentary sectional view generally similar to FIG. 3, but showing instead of the fining pad a polishing pad of the type that is employed in the polishing stage of this invention.

After the fining operation has been completed, the pad 14 is removed and is replaced by a polishing pad of the type denoted at 31 in FIG. 4. Alternatively, the pad 14 could remain on the lap, and the polishing pad 31 could be adhered to the pad 14. This pad comprises a flexible water soluble matrix 33 containing an abrasive polishing powder the particles of which are denoted at 32. This matrix 33 is secured to one side of a fabric substrate 34, which is fastened at its opposite side by a layer 35 of adhesive to a tough, flexible, reinforcing layer 36 of plastic material. The reinforcing layer 36 is in turn releasably secured to the upper surface of lap 10 by a layer 38 of high shear, low peel strength adhesive similar to that employed in layer 18 of the fining pad 14.

Figure 1:
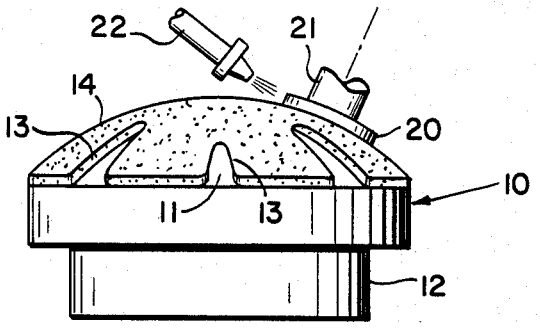
FIG. 1 is an elevational view of a conventional surfacing machine lap having thereon a fining pad of the type used during the grinding operation of this invention, and illustrating fragmentarily the lens blank mounting means and slurry feeder which form part of this machine.

During the polishing operation, the lens blank 20 is engaged with the surface of pad 31 in a manner similar to that illustrated in FIG. 1 in connection with pad 14, and an abrasive-free water stream is directed onto the lens-polishing pad interface by tube 22. Preferably, pad 31 is of the type disclosed in U.S. Pat. No. 4,576,612, so that during the polishing operation the matrix 33 slowly dissolves in the water stream, thereby slowly releasing the particles 32, which thereby combine with the water at the lap-lens interface to produce an ideal polishing slurry.

During this operation, the water can be discharged to a waste line, or if desired, may be recirculated. Polishing particles cannot contaminate future grinding operations in the same machine.

After the polishing operation on a given lens blank has been completed, the pad 31 can be removed from the lap 10 and discarded.

From the foregoing it will be apparent that the present invention provides a novel method of performing successive fining and polishing operations on a single machine with the same lap. The method is made possible through the use of a fining pad having abrasive particles fixed by a non-water soluble matrix to a substrate 15, and having on its rear surface or on the face of the lap, or on both, an improved high shear, low peel strength adhesive, which permits the fining pad to be used with an abrasive-free liquid, and which also permits the pad to be repeatedly attached to, and removed from, the surface of a lap, so that the same pad can be used for fine grinding a plurality of lens blanks, if desired. The polishing pad, which also is adapted to be releasably attached to the lap by the same type of high shear, low peel strength adhesive, is adapted to have its polishing particles or powder embedded in the polishing pad by means of a water soluble matrix, which permits the polishing particles to be released in the presence of a simple water slurry (i.e., a liquid not containing any polishing particles), as the polishing operation takes place. The liquid (water) stream used in the grinding and polishing operation may be discarded, or alternatively, may be filtered and recirculated if the desired since the amount of particles released from the fining pad during the grinding operation is rather nominal.

While this invention has been described in detail the connection with only certain embodiments thereof, it will be apparent that this application is intended to cover any further modifications thereof that may fall within the scope of one skilled in the art, or the appended claims.

I claim:

1. A method of sequentially grinding and polishing an optical surface on a lens blank removably mounted on the spindle of a lens surfacing apparatus of the type having a cooperating lens surfacing lap, said method being performed without removing said lens blank from said spindle, and comprising the steps of:

a. releasably securing on said lens surfacing lap, by means of a high shear - low peel strength adhesive, a fining pad having abrasive fining particles fixed thereto by a non-water soluble matrix;

b. fine grinding said lens surface by said fining pad in the presence of a stream of liquid which is substantially free of any abrasive fining particles, c. removing said fining pad from said lens surfacing lap;

d. releasably securing on said lens surfacing lap, by means of a high shear-low peel strength adhesive, a polishing pad having polishing particles fixed therein by a water-soluble matrix; and e. polishing said lens surface by said polishing pad in the presence of a stream of liquid which is substantially free of any abrasive fining particles, whereby said successive fine grinding and polishing steps are accomplished while said lens blank remains on the same spindle of a lens surfacing apparatus.

2. A method as defined in claim 1, further including the step of discharging to a waste line the liquid used during said fine grinding step.

3. A method as defined in claim 1, further including the step of recirculating said liquid through filtering means during said fine grinding step to remove therefrom, abrasive fining particles which may have been dislodged from said fining pad.

4. A method as defined in claim 3, wherein said liquid is water, and further including the step of recirculating said water during said fine grinding and said polishing steps without removing therefrom any polishing particles dislodged from said polishing pad.

5. A method as defined in claim 1, further including the step of removing said polishing pad from said lens surfacing lap, whereby said apparatus is ready for a repeat of steps a–e with another lens blank.

6. A method as defined 5, wherein said steps a–e are repeated using a lap different from the first - named lap.

7. A method as defined in claim 5 in which said fining pad and said polishing pad are reused in said repeat steps.

8. A method of successively effecting the fine grinding and polishing of a surface on a lens blank while retained on a single lens surfacing machine spindle of the type having thereon a lens holder positioned adjacent a cooperating lap, comprising the steps of:

a. releasably securing a lens blank in said holder, b. releasably securing a fining pad on said lap, c. fine grinding a surface on said lens blank with said fining pad while directing a stream of a substantially abrasive-free liquid onto the interface between said lens surface and fining pad, d. removing the fining pad from said lap after the fine grinding step without removing the lens blank from said holder, e. releasably securing a polishing pad on said lap, f. polishing said lens surface with said polishing pad while directing a stream of the same liquid as used in the fine grinding step onto the interface between said lens surface and polishing pad, and g. recirculating said liquid through filtering means at least during said fine grinding step, whereby said fine grinding and polishing steps are performed while said lens blank remains mounted on the same machine spindle and without cross-contamination of abrasive particles from said fine grinding step into the liquid used during said polishing step.

9. A method as defined in claim 8, wherein said liquid is water.

10. A method as defined in claim 8, including recirculating said liquid during said polishing step without removing polishing particles therefrom.

* * * * *